US005897105A

United States Patent [19]

Huggett et al.

[11] Patent Number: 5,897,105

[45] Date of Patent: Apr. 27, 1999

[54] WINCH

[75] Inventors: Richard David John Huggett, Horndean; David Roberts, Locksheath, Nr Southampton, both of United Kingdom

[73] Assignee: Lewmar Marine Limited, Havant, United Kingdom

[21] Appl. No.: 08/934,971

[22] Filed: Sep. 22, 1997

[30] Foreign Application Priority Data

Sep. 30, 1996 [GB] United Kingdom ..... 9620314

[51] Int. Cl.[6] ..... B66D 1/22; B66D 1/30

[52] U.S. Cl. ..... 254/344; 254/371

[58] Field of Search ..... 254/371, 344

[56] References Cited

U.S. PATENT DOCUMENTS 3,682,442 8/1972 Baldwin .
3,973,755 8/1976 Fawcett .
4,227,680 10/1980 Hrescak .
4,341,372 7/1982 Sugioka ..... 254/371
4,725,043 2/1988 Atfield et al. .

FOREIGN PATENT DOCUMENTS 1 353 607 5/1974 United Kingdom .
2 253 199 5/1991 United Kingdom .
82/00133 1/1982 WIPO .
88/06565 9/1988 WIPO .

*Primary Examiner*—John M. Jillions
*Attorney, Agent, or Firm*—St. Onge Steward Johnston & Reens LLC

[57] ABSTRACT

Planetary gears of an epicyclic drive train of a winch which drive a drum of the winch through a carrier which is at all times constrained to rotate with the drum, are used to keep a feeder/stripper arm of a self-tailing channel of a winch from rotating, by engagement between secondary gears and a gear ring associated with the feeder/stripper arm.

10 Claims, 1 Drawing Sheet

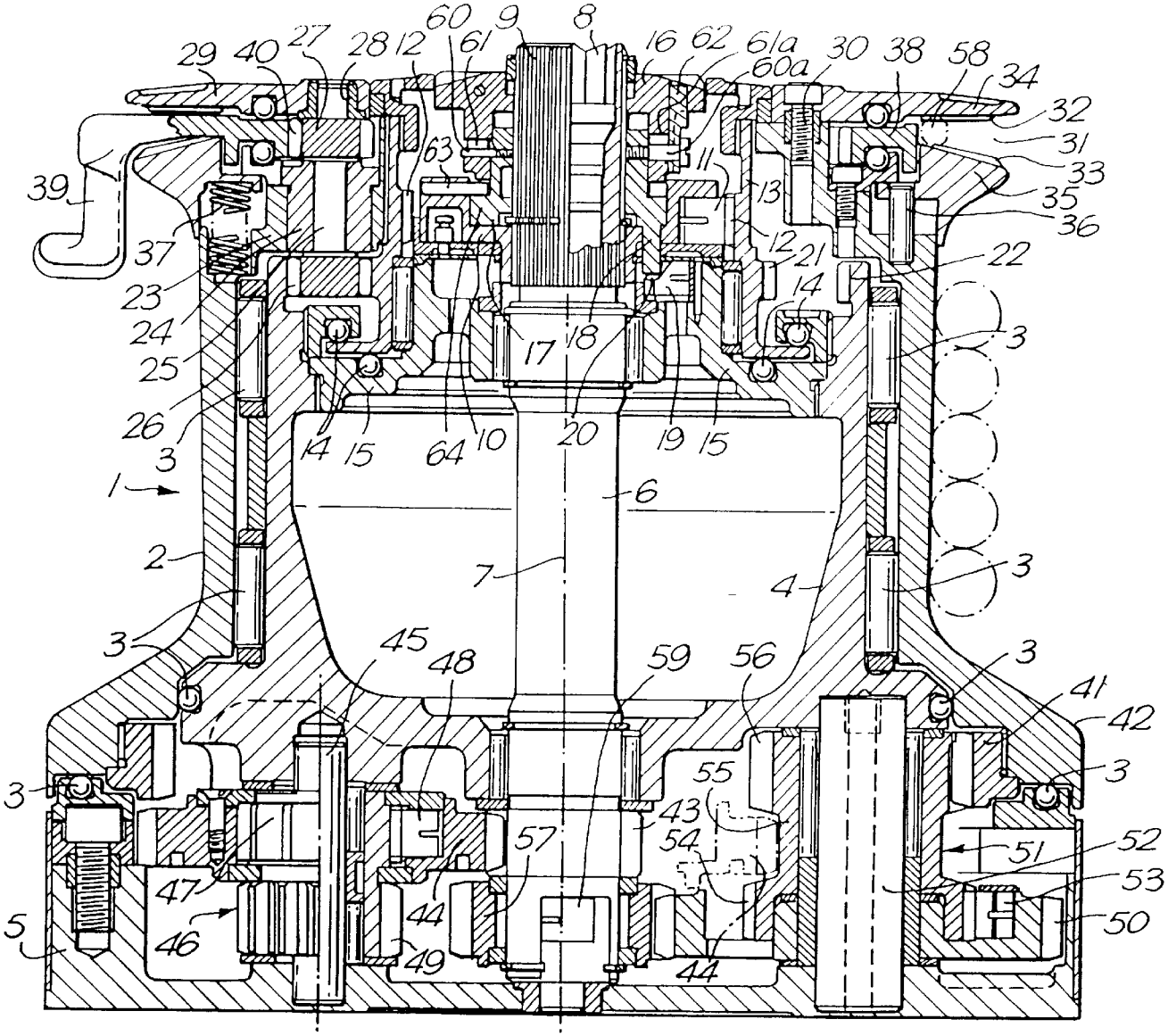

WINCH

FIELD OF THE INVENTION

This invention relates to self-tailing winches for yachts and other water-borne vessels and is concerned with the provision of an epicyclic gear drive.

BACKGROUND OF THE INVENTION

Epicyclic gears have been used in winches before—see for example U.S. Pat. No. A3682442 and GB-A-2253199.

The first of these provides an epicyclic gear in which the axes of rotation of planet gears are borne on a rotatable carrier which intervenes between the central drive shaft and the winch drum which is to be driven. Oppositely-directed sprag clutches between the drive shaft and the carrier enable either 1:1 direct drive to be transmitted through the planetary gearing, the carrier of which is effectively locked stationary by the sprag clutches in one direction of rotation of the shaft, or with a moderate reduction, 1:4 being mentioned, through mutual relative rotation of all of the shaft, the carrier and the drum.

The second of these is concerned with the provision of multiple epicyclic gear trains capable of giving extremely high reductions, provided in a detachable gearbox mounted at the head of the winch.

WO-A-82/00133 shows a planetary gear which orbits between a main drive shaft and a stationary gear ring and which is carried in a carrier which is at all times constrained to rotate with the drum of the winch.

SUMMARY OF THE INVENTION

The present invention is concerned with an epicyclic reduction mechanism which also provides for the maintenance in position of the stripper arm of a self-tailing winch. Preferably the epicyclic provides a drive ratio for a winch which has at least one other, higher reduction drive train between the shaft and the drum. This or these other drive train(s) may be of conventional type.

To achieve this, an epicyclic drive from a main shaft of a winch to a drum of that winch goes through an epicyclic train having a planetary gear which is rotatable about an axis of rotation which is at all times in a fixed rotational relationship with the drum, and a stripper arm mounted on a ring provided with an annular gear engages with a drive of the same drive diameter as the drive-transmitting planetary gear, whereby to retain the stripper arm and ring in a fixed angular relationship to a stationary frame of the winch.

This enables the provision of a ratio for example in the region of 2:1 to 3:1 which would be appropriate as a first or a second drive ratio in a three or four ratio drum.

Normally therefore there will be provided at least one and preferably two geared drive trains driven from the same shaft and offering higher drive reductions between the shaft and the drum. A selector mechanism may be provided to cause engagement only of the epicyclic and one other drive train of a plurality of such drive trains.

The winch may additionally be provided with a 1:1 drive.

BRIEF DESCRIPTION OF THE DRAWING AND OF A SPECIFIC EMBODIMENT

A particular embodiment of the invention will now be described with reference to the accompanying drawing which is a section on two radii through that embodiment.

In the embodiment, a winch 1 has a drum 2 mounted on bearings 3 on a stationary frame 4 having a base 5.

A central shaft 6 is rotatable about axis of rotation 7 and has an internally splined recess 8 at its head for reception of the key of a drive handle.

External splines 9 mount a dished ring 10 which bears outwardly sprung pawls 11 for driving engagement in the clockwise direction with an inner ratchet track 12 on an intermediate ring 13 which is journalled by bearings 14 on an inward flange part 15 of the frame 4.

The head of the shaft 6 is surrounded by a depressible annulus 16, which is limitedly rotatable relative to the shaft 6.

The annulus is to control whether an epicyclic gear or other gears—to be described below—are to be engaged upon initial clockwise rotation of the shaft 6. The mechanism is fully described in U.S. Pat. No. A3973755 (GB-A-1486777) and so will be described only briefly here.

Depression of the annulus 16 causes rotation of a shutter under influence of a spring (neither shown here) to allow pawls 11 to project to engage with ratchet track 12, and upon clockwise rotation of the shaft to drive ring 13.

On a sleeve part 17 below the annulus 16 there is housed a downwardly projecting pin 18 whose locus as it rotates interferes with an inwardly spring-loaded face cam 19. Upon clockwise rotation the pin 18 pushes the cam aside; but upon anticlockwise rotation the pin 18 is pushed upwardly and (relatively) rearwardly by engagement with a ramp face 20 of the face cam. This rotates the shutter to wipe out pawls 11 from engagement with the track 12, accumulates potential energy in its spring and raises the annulus 16. The mechanism is held in that condition until the annulus 16 is again depressed.

When the pawls 11 and ratchet track 12 are engaged, an epicyclic train which will now be described drives the drum.

The intermediate ring 13 has an outwardly directed annular ring 21 of gear teeth which are opposite to an inwardly directed ring 22 of gear teeth at the head of the stationary frame 4.

The drum 2 is extended inwardly at its uppermost portion 23 and has at regular intervals around it respective bushings 24 for receiving the axle 25 of planetary gears so that the drum is the carrier for that planetary gearing. Preferably three such planetary gears are provided equally spaced around the periphery of the drum portion 23. Each axle 25 bears two gears 26 and 27 which are of equal diameter and toothing, and the axle 25 is also journalled at 28 in a top cap 29 of the winch which is secured to the drum portion 23 by bolts 30.

Jaws of a self-tailing channel 31 are formed by a projection 34 of the top cap 29 and an annular rib 35 secured rotationally to the drum 2, but capable of axial movement relative to it guided by posts 36, under the urging of springs 37, towards the upper jaw 34. The jaws have gripper teeth 32,33 on their opposing surfaces. The jaw 35 can move to accommodate line of a wide range of diameters as indicated at 58.

A ring 38 defines the base of the self-tailing channel and has at one position on its circumference a feeder/stripper arm 39 for feeding rope into and for stripping rope out of the self-tailing channel 31. The ring 38 is rotatable relative to the drum 2 and end cap 29 and has on its inner face an annular gear ring 40 which is of the same diameter as and the same number of teeth as annular gear ring 22 on the frame 4.

The ring 38 with its arm 39 is prevented from rotation relative to the frame 4. Since the gear 27 is rigid with gear 26 through the axle 25 and the diameters and teething of those gears and of the outer gear rings 22,40 are respectively the same, the effect is that the ring 38 is not free to rotate, whatever movement or lack of it there may be in the planetary gearing arrangement.

When the shaft 6 is driven in a clockwise direction to first drive the winch, and assuming the annulus 16 is depressed, pawls 11 engage in ratchet ring 12, drive the intermediate ring 13 and thereby cause via a gear ring 21 engaging gear 26 a rolling action of the gear 26 around the gear ring 22 on the frame. The drum 2 via its inwardly projecting portion 23 and bushing 24 is the carrier for the planetary gear and the drum is therefore driven in rotation. If as is conventional the first ratio is engaged by clockwise rotation of the shaft, rotation of the gears 26,27 about their own axes of rotation will be anti-clockwise but the effect will be to displace the drum 2 in a clockwise rotation. The drive ratio is equal to one plus the quotient of the number of teeth on the annular drive ring 26 divided by the number of teeth on the intermediate ring 21.

Thus if there are 96 teeth on ring 26 and 72 on ring 21 we get a total gear ratio of 2.3:1.

It is primarily intended that this epicyclic arrangement will be the first ratio of a winch having at its base at least one and preferably two, perhaps three, conventional geared drive trains affording progressively higher transmission reduction ratios and therefore progressively higher mechanical advantages.

In this embodiment conventional gear trains offering successively greater mechanical advantages and successively engaged by reversal of direction of rotation of the shaft 6 are provided on the base 5 of the frame. These drive from the shaft to a second drum gear ring 41 secured into the flare 42 at the bottom of the drum 2.

However, engagement of the third drive may be prevented by depression and manual rotation of the annulus 16 which has the effect of withdrawing the pin 18 from interference with the cam 19 so that upon second reversal, the epicyclic gear train again drives the drum.

The sleeve part 17 is linked to annulus 16 by pins 60 which pass through slots 61 in the annulus. An indicator 62 is secured to a pin 60*a* which protrudes through an inclined slot 61*a* in the annulus 16. A pin 63 projects inwardly from the ring 10 and can engage over an intermittent ledge 64 on the part 17, which is urged upwardly by springs (not shown).

Depression of the annulus 16 without rotation has the effect already described. If however it is at the same time twisted, pin 60*a* rides in the inclined slot 61*a* to cause an upward motion of the pin 18 relative to the annulus, the pin 18 being withdrawn from interference with the cam 19, so the part 17 is not driven relatively rearwardly and the ledge 64 is not freed from its retention by pin 63. Third speed can only be engaged upon manual reversal of the twist imposed on the annulus 16. Indicator 62 projects to show that that manual intervention would be needed.

The gear part 50 is permanently in mesh not only with gear 49 but also with gear 57 driven via pawls 59 near the bottom of the shaft 6.

Pawls and ratchets 53,54 on the one hand and 47,48 on the other are oppositely directed, with 53,54 permitting relative rotation of the gear parts 50,55 in a direction representing overrun of the drum 2. This can occur when slack line is being drawn onto the drum by hand tailing and will occur when the epicyclic drive train is engaged since its drive ratio is lower than that given by the gear trains at the base. However, attempted back rotation of the drum is prevented by this opposed setting.

Drive in the first of the gear trains is on anti-clockwise rotation of the shaft 6 from pawl 59 into gear 57 which in turn drives gear part 50, pawl and ratchet 53,54, gear 56 to ring 41.

A second of these gear trains originates at teeth 43 formed in the shaft 6. This meshes with an outer part 44 of a compound gear 46 journalled on a stationary shaft 45.

Compound gear 46 includes a ratchet track 47 drivingly engaged in one direction of rotation of the part 44 by pawls 48 on that part. This direction corresponds to clockwise rotation of the shaft 6. Ratchet track 47 is unitary with gear teeth 49. These mesh directly with a first part 50 of a second compound gear 51 both parts of which are separately journalled on a massive stationary shaft 52. The part 50 is engageable via pawls 53 engaging a ratchet track 54 with a second part 55 of the compound gear, which part includes gear teeth 56 permanently in mesh with the gear ring 41 of the drum 2.

If the annulus 16 is not depressed initial rotation (conventionally in the clockwise direction) will engage the third drive ratio, i.e. that of highest mechanical advantage; but the user will rapidly realise that and will wind anti-clockwise to engage the second drive ratio.

If the annulus is depressed and the shaft is rotated clockwise the first drive engaged is the epicyclic drive, then the second upon first reversal and (because the pawls 11 have now been wiped out) the third upon second reversal.

As explained above, the first drive epicyclic can be kept alternately engaged by depressing the annulus 16 and twisting, effectively withdrawing the pin 18 in an upward direction to avoid the ramp face 20 of the cam 19.

We claim:

1. A self-tailing winch comprising:

a drum rotatable about an axis of rotation;

a main drive shaft;

an epicyclic train, drive from the drive shaft to the drum being through the epicyclic train;

at least one planetary gear in the epicyclic train, the at least one planetary gear being rotatable about its own axis of rotation and being borne on a carrier which is at all times constrained to rotate with the drum and engaging a gear ring on a stationary frame of the winch;

a self-tailing channel adjacent the drum; and, a feeder/stripper arm in the self-tailing channel, the feeder/stripper arm being maintained by at least one of the planetary gears in a rotationally fixed position relative to the stationary frame of the winch.

2. A self-tailing winch according to claim 1 wherein a gear ring associated with the feeder/stripper arm is engaged by a gear coaxial with and of the same drive diameter as the planetary gear(s) engaged with the gear ring on the stationary frame of the winch.

3. A self-tailing winch according to claim 1 further comprising at least one other drive train between the drive shaft and the drum, the at least one other drive train being of higher mechanical advantage than the epicyclic train.

4. A self-tailing winch according to claim 3 wherein the other drive train or a first of them is engageable upon rotation of the drive shaft in a first direction which is the same direction of rotation as that in which the epicyclic train is driven from that shaft.

5. A self-tailing winch according to claim 4 wherein there is a plurality of said other drive trains, a second of them being engageable to drive the drum upon a reversal of direction of rotation of the drive shaft to a second direction.

6. A self-tailing winch according to claim 4 further comprising a selector for determining which one of the epicyclic train and the first of the other trains will be engaged upon an initial rotation of the drive shaft.

7. A self-tailing winch according to claim 5 further comprising a selector for determining which one of the epicyclic train and the first of the other trains will be engaged upon an initial rotation of the drive shaft.

8. A self-tailing winch according to claim 7 wherein the selector is further operable to determine to which of a first and a second condition the selector will be returned upon rotation of the drive shaft in the second direction, namely a first condition in which the epicyclic train will be engaged and a second condition in which the first of the other drive trains will be engaged, upon rotation of the drive shaft in the first direction.

9. A self-tailing winch according to claim 1 wherein a plurality of said planetary gears are borne in respective carriers journalled in the drum.

10. In a self-tailing winch having a drum driven by an epicyclic drive train having at least one planetary gear and a self-tailing channel, the improvement comprising a feeder/stripper arm for the self-tailing channel maintained in a given fixed rotational position by said at least one planetary gear.

* * * * *